US007444920B2

(12) United States Patent
Herrmann et al.

(10) Patent No.: US 7,444,920 B2
(45) Date of Patent: Nov. 4, 2008

(54) VALVE ARRANGEMENT FOR THE ACTIVATION OF A STRUCTURAL ELEMENT

(75) Inventors: Tobias Herrmann, Ebertsheim (DE); Wolfgang Warmuth, Mannheim (DE)

(73) Assignee: ABB Patent GmbH, Ladenburg (DE)

( * ) Notice: Subject to any disclaimer, the term of this patent is extended or adjusted under 35 U.S.C. 154(b) by 254 days.

(21) Appl. No.: 11/507,462

(22) Filed: Aug. 22, 2006

(65) Prior Publication Data

US 2007/0044651 A1 Mar. 1, 2007

(30) Foreign Application Priority Data

Aug. 23, 2005 (DE) ..... 10 2005 040 039

(51) Int. Cl.
*F15B 11/10* (2006.01)
*F15B 13/044* (2006.01)

(52) U.S. Cl. ..... 91/433; 91/444; 91/449; 91/459; 91/461

(58) Field of Classification Search ..... 91/433, 91/442, 444, 449, 457, 459, 461
See application file for complete search history.

(56) References Cited

U.S. PATENT DOCUMENTS 3,954,249 A * 5/1976 Gratzmuller ..... 91/461
4,640,095 A * 2/1987 Engel et al. ..... 91/444
5,476,030 A 12/1995 Plettner

FOREIGN PATENT DOCUMENTS

DE 43 30 038 A1 3/1995
DE 43 36 074 C2 4/1995
EP 0 641 919 A1 3/1995

OTHER PUBLICATIONS

*German Search Report dated Feb. 7, 2006 (with English translation of category of cited documents).

* cited by examiner

*Primary Examiner*—Michael Leslie
(74) *Attorney, Agent, or Firm*—Buchanan Ingersoll & Rooney PC

(57) ABSTRACT

The valve arrangement for the activation of a structural element has three inlet switching valves through which a pressure-loaded medium can be conducted. These inlet switching valves are connected on their inflow side to a pressure supply by inflow lines and are arranged parallel to one another in flow terms. Moreover, the valve arrangement has a connection element, which is connected to outflow sides of all the inlet valves by pressure lines. A control line acted upon by the medium is connected to the pressure supply. The three switching-valve groups can be activated by the control line, and in each case two switching valves and in each case one inlet switching valve are assigned to each switching-valve group. A activation valve can be interposed in each case between a switching-valve group and the control line. Three outflow lines for the medium can be arranged between an outflow location for the medium and the connection element. The switching valves of each outflow line can be actuated by different activation valves.

20 Claims, 2 Drawing Sheets

10

VALVE ARRANGEMENT FOR THE ACTIVATION OF A STRUCTURAL ELEMENT

CROSS-REFERENCE TO RELATED PATENT APPLICATION

This application claims the benefit of German Application No. 10 2005 040 039.6, filed on Aug. 23, 2005 in the German Intellectual Property Office, the disclosure of which is incorporated herein in its entirety by reference.

BACKGROUND

A valve arrangement is disclosed for the activation of a structural element, with three inlet switching valves, through which a pressure-loaded medium can be conducted and which are connected on their inflow side to a pressure supply by means of inflow lines and are arranged parallel to one another in flow terms, and with a connection element for the structural element, which connection element is connected to outflow sides of all the inlet switching valves by means of pressure lines.

Valve arrangements of this type are generally known. For example, such valve arrangements are designed as trip blocks with 2 of 3 switching and are known, for example, for triggering the quick-acting shut-off of a quick-acting shut-off valve, in particular of gas or steam turbines. The designation 2 of 3 indicates in this case that, of three signal channels present, at least 2 must be actuated in order to trigger the quick-acting shut-off signal. In this context, in particular, hydraulically based arrangements have proved appropriate, that is to say the control medium for triggering the quick-acting shut-off signal is usually a hydraulic oil.

Known valve arrangements, as a consequence of construction, cannot detect or monitor the conditions or the operating state at every location in the arrangement.

SUMMARY

A valve arrangement is disclosed for the activation of a structural element, the said valve arrangement affording a monitoring possibility for each individual component of the arrangement.

An exemplary valve arrangement is provided for the activation of a structural element of the type mentioned in the introduction wherein a control line acted upon by the medium is connected to the pressure supply, wherein three switching-valve groups can be activated by means of the control line, wherein two switching valves and one of the inlet switching valves are assigned to each switching-valve group, wherein an activation valve is interposed in each case between a switching-valve group and the control line, by means of which activation valve the switching actions of the switching valves and of the inlet valve of the corresponding switching-valve group are made possible, wherein three outflow lines for the medium, which are connected in parallel in flow terms, are arranged between an outflow location for the medium and the connection element wherein two switching valves are arranged in a series connection in each of the outflow lines, and wherein the switching valves of each outflow line are actuated by different activation valves.

This can ensure that the 2 of 3 principle is implemented by a mechanical arrangement of various valves in the arrangement, so that there is a possibility of detecting or monitoring both the states of the valves and their physical conditions and also all the desired states of the pressure medium between the valves or the connected lines. This also ensures that any conceivable or desired variable can be monitored. In an advantageous refinement, the activation valve is designed as a solenoid valve.

An also particularly simple activation of the valve arrangement thus becomes possible. In this case, each solenoid valve constitutes a channel of an activation signal which can be activated separately. In the present instance, three channels, that is to say three activation possibilities, are present. If only one of these channels fails, the 2 of 3 principle ensures that the valve arrangement is still in the operationally ready state. In this case, it is only of minor importance whether this channel has failed because of an electrical or a hydraulic fault.

Advantageously, by means of an exemplary valve arrangement, the generally known fail-safe principle can be implemented in that, for example, the switching vales, the inlet valves and/or the activation valves have a return element, in particular a return spring, which, when the valve is in the inoperative state, keeps the latter in or brings the latter into a predetermined valve position, to be precise the fail-safe position.

As regards the inlet switching valves, which can be designed as hydraulic valves, the "closed position" is the position in the inoperative state. For the switching valves, which are normally likewise hydraulically driven valves, the "open position" is the position in the inoperative state, and, for the solenoid valves, the electrical actuating force works in each case counter to the return element, so that, in the dead state, the return element of the valve likewise transfers the latter into the position of the inoperative state.

An advantageous exemplary embodiment is provided wherein the valves, to be precise the inlet valves, the switching valves and the activation valves, are arranged in a common housing.

Thus, a particularly space-saving arrangement can be achieved. Mounting is simplified and possible mounting errors are reduced to a minimum.

For evaluating the state of the valve arrangement and for constant state monitoring, in particular, pressure signals can be provided at various locations in the valve arrangement according to the invention.

Moreover, to set specific flows and pressures within the valve arrangement or in the corresponding connecting lines of the valve arrangement, throttle members, such as, for example, throttle diaphragms, adjusting diaphragms or else valves and the like, can be provided, so that the valve arrangement according to the invention can be set in a particularly simple way.

In an alternate exemplary embodiment, a valve arrangement follows as a safety principle a 2 of 4, 2 of 5, 3 of 4, 3 of 5, 3 of 6, etc. principle, that is to say offers any desired channel-switching possibility to be organized according to the requirements of a safety stipulation. By means of a valve arrangement of this type, too, advantages can be achieved.

Further advantageous refinements of a stop device are disclosed.

BRIEF DESCRIPTION OF THE DRAWINGS

Advantageous refinements and improvements and particular advantages will be explained and described in more detail with reference to an exemplary embodiment illustrated in the drawings in which.

DETAILED DESCRIPTION

Figure 1:
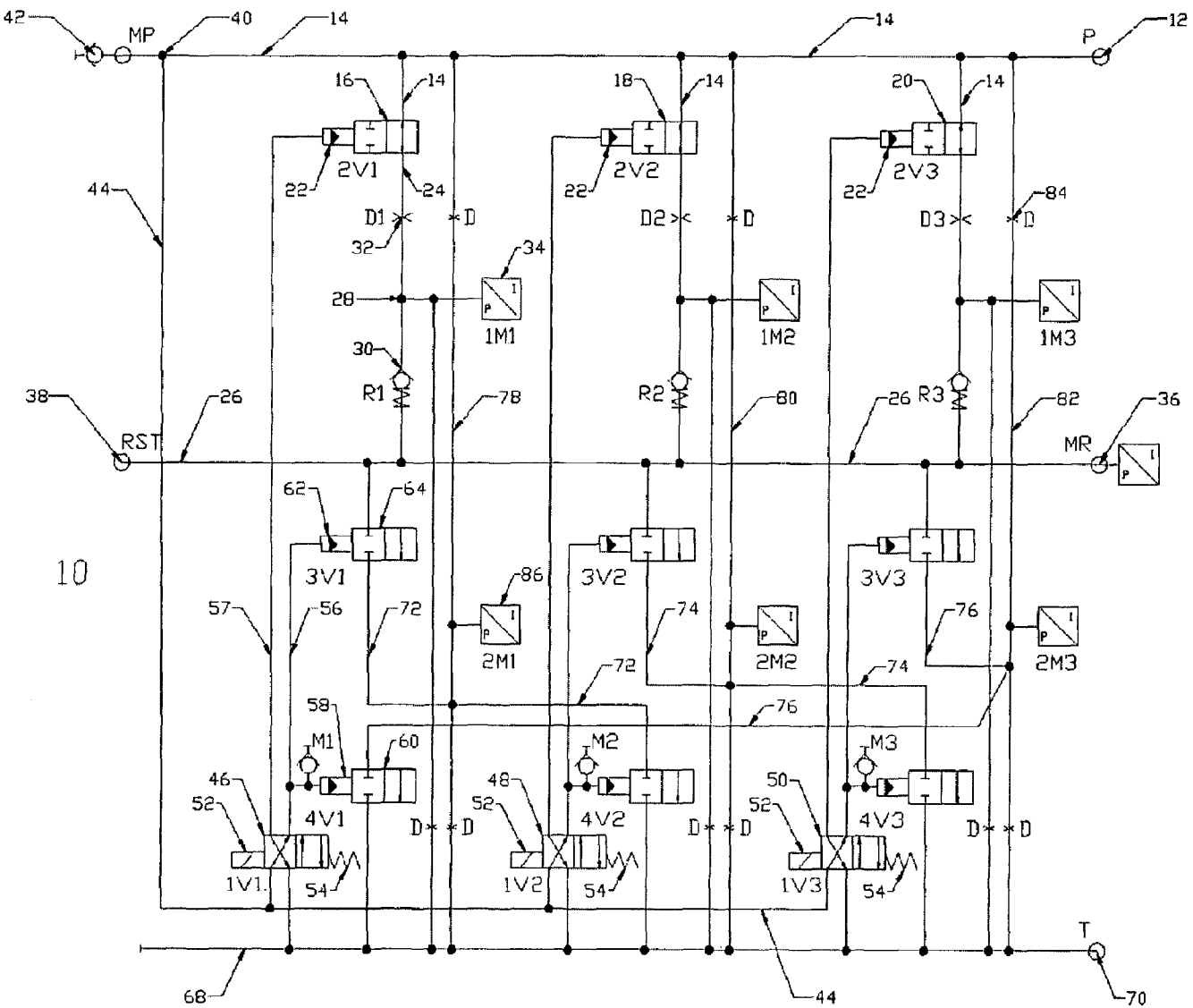
FIG. 1 shows a basic diagram of an exemplary trigger device in the operating state.

FIG. 1 shows a trigger device 10 in a diagrammatic illustration, three signal channels being available in the present example, two of these channels having to be triggered in order to actuate the trigger device 10. Moreover, in this example, the valves, sensors and pipelines shown are implemented essentially in a single device, so that the trigger device 10 has a particularly compact and therefore space-saving configuration.

The trigger device 10, by having a first flange 12, is provided for being connected to a pressure supply which is not illustrated in this figure. The embodiment, as shown in the figure, is implemented by a hydraulic system, so that the pressure supply is ensured, for example, by a pump for hydraulic oil. The trigger device 10 is supplied with hydraulic oil through the connection point at the first flange 12 with the first pipeline 14. In this case, a first 16, a second 18 and a third 20 inlet switching valve are connected to the first pipeline 14 in parallel in flow terms. The inlet switching valves 16, 18, 20 in this case have essentially two switching positions, with a first switching position shown in this figure and to be designed as "open", so that the hydraulic oil flows through the inlet switching valves 16, 18, 20. A second switching position, which is designed as "closed", can be set by means of the inlet switching valves 16, 18, 20, wherein a hydraulic cylinder 22 present on each inlet switching valve 16, 18, 20 is actuated and changes the valve position correspondingly. In this case, the hydraulic cylinder 22 works counter to a spring, which, in the event of a failure of the hydraulics, in particular in the event of a pressure loss at the hydraulic cylinder 22, brings the inlet switching valves 16, 18, 20 into the predetermined "open" first position.

The hydraulic oil then flows from the first flange 12 through the first pipeline 14 to and through the first inlet switching valve 16, which is connected on the outlet side to a first side of a second pipeline 24, whilst a second side of the second pipeline 24 conducts the hydraulic oil into a collecting pipe 26. At a first pipeline branch 28, a first non-return valve 30 with pipeline connection pieces is arranged between the first pipeline branch and the collecting pipe 26. Branches or connection points of lines are emphasized in the figure by black dots.

In this case, the first spring-loaded non-return valve 30 ensures that hydraulic oil passes into the collecting pipe 26 only beyond a set minimum pressure, and, under corresponding pressure conditions in the pipelines, a backflow of oil counter to the planned pressure drop back into the second pipeline 24 is prevented. A pressure safeguard for the system is thereby implemented.

Between the first pipeline branch 28 and the first inlet switching valve 16, a first adjustable diaphragm 32 is arranged as a throttle member. By means of the first diaphragm 32, a predeterminable pressure and therefore also the throughflow quantity are set in the second pipeline 24. Downstream of the first diaphragm 32 is arranged a first pressure sensor 34 which measures the pressure downstream of the first diaphragm 32.

In a comparable way, further pipelines, diaphragms and pressure sensors also follow the second 18 and third 20 inlet switching valve and all conduct hydraulic oil into the collecting pipe 26. For the sake of clarity in the figure, however, the corresponding reference symbols have been omitted here. Moreover, the collecting pipe 26 has a second pressure sensor 36 which measures the resulting pressure of all three delivery systems of the pressure supply via the inlet switching valves 16, 18, 20. Furthermore, the collecting pipe 26 also has a connection point 38 with a connection element, not illustrated in any more detail, to which, generally speaking, a structural element can be connected. In a preferred embodiment, the structural element is a quick-acting shut-off valve, for example for a gas or steam turbine, the said valve ultimately receiving a regulating signal via the connection element. As long as a specific pressure prevails in the collecting pipe 26 and therefore at the connection point, the quick-acting shut-off valve remains open. In the other situation, when a pressure drop in the collecting pipe 26 below the specific prefixed value prevails, the quick-acting shut-off valve will close, in particular will move into its "closed" position due to a specific prestressing force. The quick-acting shut-off valve can therefore be used as a safety valve.

Moreover, the first pipeline 14 also branches at a second pipeline branch 40, on the one hand, to a pressure relief valve 42 and, on the other hand, into a control line 44. The control line 44 conducts the hydraulic oil, which is then used as control oil, to a first 46, to a second 48 and to a third 50 activation valve. These activation valves 46, 48, 50 are in this case designed such that they are activated electromagnetically, this being symbolized by a corresponding symbol 52 in the figure. The drive works in each case counter to a spring 54 which, in the event of the failure of the drive, ensures that the activation valves 46, 48, 50 are brought into a construction-induced position and are held there.

The action of the activation valves 46, 48, 50, then, will be explained in more detail by reference to the first activation valve 46. This can be designed such that it simultaneously switches two hydraulic lines by means of one switching movement. In the example illustrated in this figure for the first switching position, the hydraulic oil is in this case conducted from the control line 44 to a first delivery line 56 which ensures that the pressure is delivered by means of the hydraulic oil to a first control cylinder 58 of a first switching valve 60 and to a second control cylinder 62 of a second switching valve 64.

The pressure prevailing upstream of the first 60 and the second 64 switching valve has the effect that the corresponding control cylinders 60, 62 bring the switching valves 68, 64 into the first switching position. In this case, each of the switching valves 60, 64 also works counter to a spring, so that the switching position of the switching valves 60, 64 is reached only as long as a pressure prevails upstream of the control cylinders 58, 62. Should a pressure drop be brought about in this system for any reason, the respective switching valves 60, 64 is automatically transferred, due to the faults, into its second switching position which releases the hydraulic path through the valve. Moreover, a second pressure relief valve is interposed in the first delivery line 56 between the first switching valve 60 and the first activation valve 46. The said pressure relief valve, in particular, can fulfil a safety function.

Furthermore, the hydraulic cylinder 22 of the first inlet switching valve 16 is connected via the second delivery line 57 and the first activation valve 46 to a drainage pipe 68 which ultimately leads to an essentially pressureless outflow location 70 which recirculates the hydraulic oil arriving there into an oil system. The latter, in turn, is, as a rule, connected to the pressure supply, thus resulting, overall, in a closed circuit, not illustrated in any more detail, for the hydraulic oil. Moreover, the second delivery line 57 ensures that, in the illustrated first switching position of the first activation valve 46, its hydraulic cylinder 22 is not activated, and therefore the return spring, not illustrated, has brought the first inlet switching valve 16 into the switching position shown.

The collecting pipe 26 is connected to the drainage pipe 68 by means of the first 72, a second 74 and a third 76 drainage line. In this case, in the first drainage line 72, the second switching valve 64 and also a further switching valve, which is switched by the second activation valve 48, are installed in series into the pipeline. This ensures, according to the invention, that, in the first drainage line 72, by means of the above-mentioned switching valves, the throughflow of the hydraulic oil can flow out from the collecting pipe 26 at two locations at a comparatively high pressure level into the drainage pipe 68 which has a comparatively low pressure level. Only when both switching valves are switched to pressureless at their control cylinder and are therefore open is the outflow of the hydraulic oil through the first drainage pipe 72 ensured.

Correspondingly, in the second drainage line 74, two switching valves are likewise arranged, of which a first is activated by the second activation valve 48 and a second valve via the third activation valve 50. Moreover, the corresponding two switching valves in the third drainage line 76 are activated by the third activation valve 50 and by the first activation valve 46 respectively.

It can be ensured by this switching and is evident from it that the in each case two switching valves in each drainage line 72, 74, 76 are activated by various combinations of two of the three activation valves 46, 48, 50. For switching, this means that, even should one of the switching valves fail and be brought into its fail-safe position by the return spring and consequently release the path for/through the hydraulic oil to the respective switching valve, in each drainage line 72, 74, 76 there is still a second switching valve which still blocks the throughflow of the hydraulic oil. It is ensured, furthermore, that a failure of one of the activation valves 46, 48, 50 does not bring about the pressure drop in the collecting pipe 26. This is because each of the activation valves 46, 48, 50 activates overall two of the switching valves. These are, however, installed in each case in different drainage lines 72, 74, 76, so that a pressure drop, for example in the first delivery line 56, has the effect only that the first switching valve 60 in the third drainage line 76 is switched to passage and the second switching valve 64 in the first drainage line 72 is switched to passage. In both drainage lines 72, 76, however, there is still a further switching valve which ensures that the drainage lines 72, 76 remain closed and no pressure drop is brought about in the collecting pipe 26. Thus, a mechanical switching of the two of three principle can be ensured.

Furthermore, the first pipeline 14 is also connected to the drainage pipe 68 by means of a first 78, a second 80 and a third 82 bypass line. These serve particularly for the convenient setting of the pressure conditions in the system. For this purpose, throttle members 84, for example throttle diaphragms, are installed in the bypass lines 78, 80, 82 at the locations identified by "D". The pressure conditions upstream of these throttle members can thereby be set in a particularly simple way. In this case, the first bypass line 78 is connected to the first drainage line 72, specifically in the pipeline portion between the two switching valves, the two throttle members "D", which are installed in the first bypass line 78, being arranged upstream and downstream of the connection point. Moreover, between the two installed throttle members, a third pressure sensor 86 is also arranged, which correspondingly measures the pressure between the two throttle points and moreover, on the principle of connected pipes, also the pressure between the two switching valves of the first drainage line 72. Via the pressure level which is established there, it is possible to ascertain whether one of the two switching valves is open and from this draw conclusions as to corresponding faults or damage in the system or the switching valves or else of the activation valves. However, the measurement evaluation instruments used for this purpose and, if appropriate, further measurement and conduction technology are not shown in the figure.

Correspondingly, the second bypass line 80 is connected to the second drainage line 74 and the third bypass line 82 to the third drainage line 76. However, for the sake of simplification, the corresponding reference symbols are not inserted in the figure.

Figure 2:
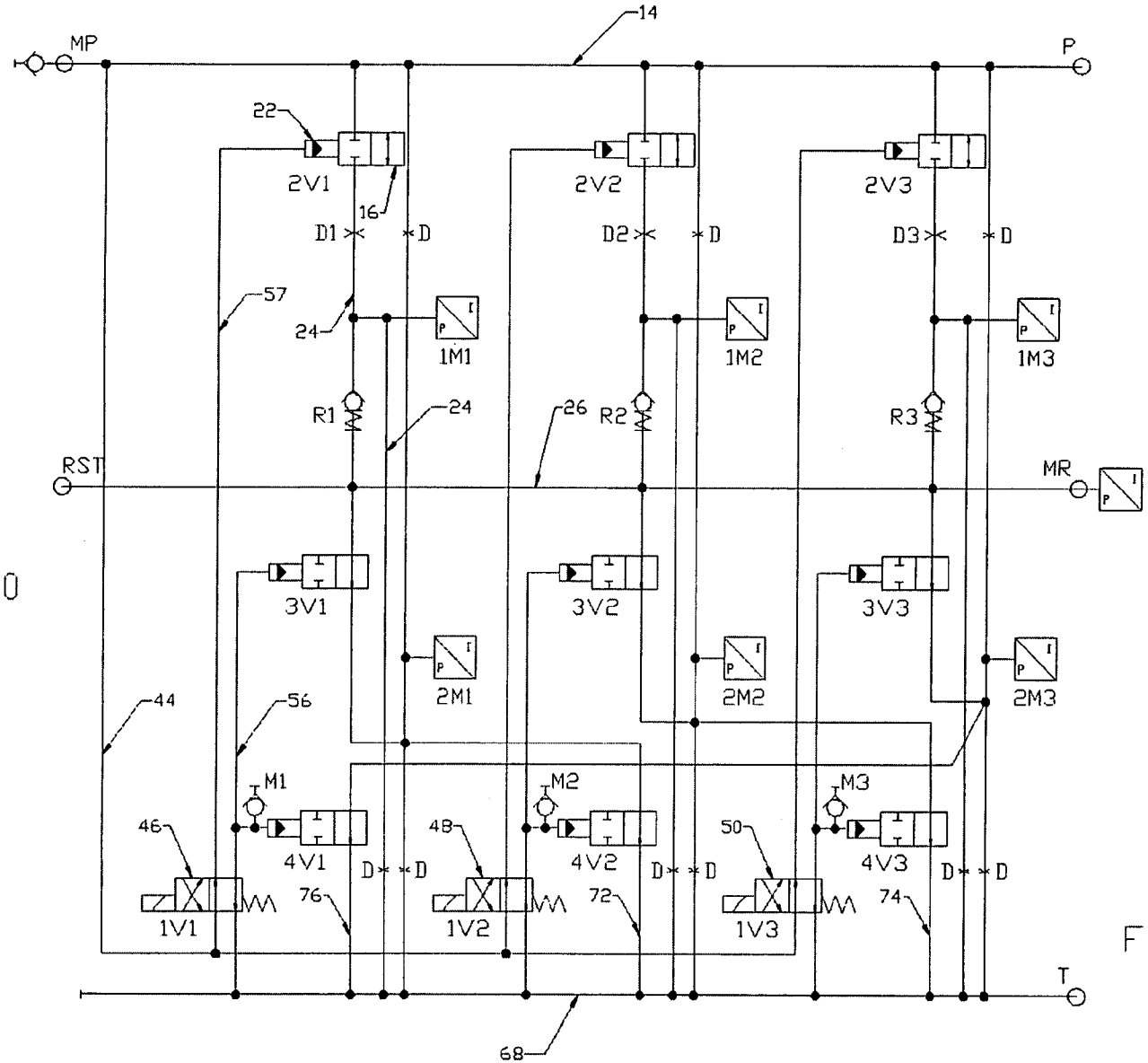
FIG. 2 shows the basic diagram of the exemplary trigger device in the triggered state.

FIG. 2 shows the trigger device 10, in which, by the corresponding activation of the activation valves 46, 48, 50, the system has been switched to pressureless at the connection point, in order to ensure that a quick-acting shut-off valve connected to it performs its quick-acting shut-off function. Since this figure relates to the same trigger device 10 as FIG. 1, the reference symbols used above are also used for the same components in this figure. However, only those components necessary for explaining this figure or the differences from FIG. 1 are given reference symbols.

In the present instance, the activation valves 46, 48, 50 are deliberately switched dead, so that the corresponding return springs on these valves bring these into a predefined end position, the second position, and hold them there. The internal switching of the activation valves 46, 48, 50 is in this case configured such that the pressure prevailing in the control line 44 arrives via the first activation valve 46 at the second delivery line 57 and thus supplies the hydraulic cylinder 22 with pressure, and therefore the first inlet switching valve 16 is brought into a position in which the flow of hydraulic oil through the first pipeline 14 to the second pipeline 24 is interrupted. Since all the inlet switching valves 16, 18, 20 close the first pipeline 14, the pressure supply to the collecting pipe 26, overall, is prevented.

Furthermore, as a result of the described valve position of the first activation valve 46, the first delivery line 56 is then connected to the drainage pipe 68. This ensures that the first switching valve 60 and the second switching valve 64 or their control cylinders 58, 62 are pressureless, so that the return springs present there also bring these switching valves 60, 64 into the second position and holds them there. In this position, the valves allow the passage of hydraulic oil from the collecting pipe 26 to the drainage pipe 68. Since in each case two switching valves are present in each drainage line 72, 74, 76, both switching valves are switched to passage, so that the hydraulic oil can pass from the collecting pipe 26 into the drainage pipe 68. This can be achieved, wherein, for example, all three activation valves 46, 48, 50 are switched dead, so that all the switching valves present are brought into their second position and are also held there.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Trigger device
12 First flange
14 First pipeline
16 First inlet switching valve
18 Second inlet switching valve
20 Third inlet switching valve

22 Hydraulic cylinder
24 Second pipeline
26 Collecting pipe
28 First pipeline branch
30 First non-return valve
32 First diaphragm
34 First pressure sensor
36 Second pressure sensor
38 Connection point
40 Second pipeline branch
42 Pressure relief valve
44 Control line
46 First activation valve
48 Second activation valve
50 Third activation valve
52 Symbol
54 Spring
56 First delivery line
57 Second delivery line
58 First control cylinder
60 First switching valve
62 Second control cylinder
64 Second switching valve
66 Second pressure relief valve
68 Drainage pipe
70 Outflow location
72 First drainage line
74 Second drainage line
76 Third drainage line
78 First bypass line
80 Second bypass line
82 Third bypass line
84 Throttle member
86 Third pressure sensor

The invention claimed is:

1. Valve element for the activation of a structural element, comprising:

three inlet switching valves, through which a pressure-loaded medium can be conducted and which are connected on their inflow side to a pressure supply by means of inflow lines and are arranged parallel to one another in flow terms;

a connection element for the structural element, which connection element is connected to outflow sides of all the inlet switching valves by means of pressure lines;

a control line acted upon by the medium connected to the pressure supply, three switching-valve groups can be activated by means of the control line, wherein two switching valves and one of the inlet switching valves are assigned to each switching-valve group, wherein an activation valve is interposed in each case between a switching-valve group and the control line, by means of which activation valve the switching actions of the switching valves and of the inlet valve of the corresponding switching-valve group are made possible; and three outflow lines for the medium, which are connected in parallel in flow terms, and are arranged between an outflow location for the medium and the connection element, wherein two switching valves are arranged in a series connection in each of the outflow lines, and wherein the switching valves of each outflow line are actuated by different activation valves.

2. Valve arrangement according to claim 1, wherein the medium is a gas or liquid.

3. Valve arrangement according to claim 1, wherein the structural element is a quick-acting shut-off valve or a safety device.

4. Valve arrangement according to claim 1, wherein the activation valve is a solenoid valve.

5. Valve arrangement according to claim 1, wherein the switching valves, the inlet valves and/or the activation valves have a return spring which, when the valve is in the inoperative state, keeps the latter in or brings the latter into a predetermined valve position.

6. Valve arrangement according to claim 1, wherein the switching valves, the inlet valves and the activation valves or the valves of a switching-valve group are arranged in a common housing.

7. Valve arrangement according to claim 1, wherein a pressure sensor is arranged in each pressure line connected to an inlet switching valve.

8. Valve arrangement according to claim 1, wherein a pressure sensor is arranged in each outflow line in the line portion between the two switching valves arranged in the respective outflow line.

9. Valve arrangement according to claim 1, wherein three bypass lines, with at least one throttle member in each bypass line, are arranged between the inflow lines and the outflow lines, and wherein the bypass lines are connected to the outflow lines in the region between the switching valves and the outflow location of the bypass lines.

10. Valve arrangement according to claim 1, wherein in each case one bypass line is connected to an outflow line, and wherein the connection point is arranged between the two switching valves in the respective outflow line.

11. Valve arrangement for the activation of a structural element, comprising:

at least three inlet switching valves, through which a pressure-loaded medium can be conducted and which are connected on their inflow side to a pressure supply by means of inflow lines and are arranged parallel to one another in flow terms;

a connection element for the structural element, which connection element is connected to outflow sides of all the inlet switching valves by means of pressure lines;

a control line acted upon by the medium is connected to the pressure supply, wherein a first number of switching-valve groups can be activated by means of the control line, wherein the first number corresponds to the number of inlet-valve groups present, wherein a second number of switching valves and one of the inlet switching valves are assigned to each switching-valve group, wherein the second number is obtained from a result of the first number minus a whole number, insofar as the result is the number two or a greater number; and an activation valve interposed in each case between a switching-valve group and the control line, by means of which activation valve the switching actions of the switching valves and of the inlet valve of the corresponding switching-valve group are made possible, wherein the first number of outflow lines for the medium, which are connected in parallel in flow terms, are arranged between an outflow location for the medium and the connection element, wherein a second number of switching valves are arranged in a series connection in each of the outflow lines, and wherein the switching valves of each outflow line are actuated by different activation valves.

12. Valve arrangement according to claim 2, wherein the structural element is a quick-acting shut-off valve or a safety device.

13. Valve arrangement according to claim 2, wherein the activation valve is a solenoid valve.

14. Valve arrangement according to claim 3, wherein the activation valve is a solenoid valve.

15. Valve arrangement according to claim 2, wherein the switching valves, the inlet valves and/or the activation valves have a return spring which, when the valve is in the inoperative state, keeps the latter in or brings the latter into a predetermined valve position.

16. Valve arrangement according to claim 3, wherein the switching valves, the inlet valves and/or the activation valves have a return spring which, when the valve is in the inoperative state, keeps the latter in or brings the latter into a predetermined valve position.

17. Valve arrangement according to claim 4, wherein the switching valves, the inlet valves and/or the activation valves have a return spring which, when the valve is in the inoperative state, keeps the latter in or brings the latter into a predetermined valve position.

18. Valve arrangement according to claim 2, wherein the switching valves, the inlet valves and the activation valves or the valves of a switching-valve group are arranged in a common housing.

19. Valve arrangement according to claim 3, wherein the switching valves, the inlet valves and the activation valves or the valves of a switching-valve group are arranged in a common housing.

20. Valve arrangement according to claim 4, wherein the switching valves, the inlet valves and the activation valves or the valves of a switching-valve group are arranged in a common housing.

* * * * *